US005549207A

United States Patent [19]

Busico et al.

[11] Patent Number: 5,549,207

[45] Date of Patent: Aug. 27, 1996

[54] METAL PARTICLE SWEEPER

[76] Inventors: Kathleen Busico; Cynthia C. McCreery, both of 17366 Via Susana, San Lorenzo, Calif. 94580

[21] Appl. No.: 380,295

[22] Filed: Jan. 30, 1995

[51] Int. Cl.[6] ..... B07C 7/04

[52] U.S. Cl. ..... 209/614; 209/215; 209/228; 209/636

[58] Field of Search ..... 209/213, 215, 209/228, 614, 636; 15/105, 257.2, 257.6, 339

[56] References Cited

U.S. PATENT DOCUMENTS

| | | | |
|---|---|---|---|
| 2,426,795 | 9/1947 | Sjostrom | 209/215 |
| 2,654,480 | 10/1953 | Stem | 209/215 |
| 4,407,038 | 10/1983 | Haase | 209/215 X |
| 5,285,904 | 2/1994 | Haase | 15/339 X |
| 5,413,225 | 5/1995 | Shields | 209/614 |

FOREIGN PATENT DOCUMENTS

| | | | |
|---|---|---|---|
| 2367474 | 6/1978 | France | 209/215 |

*Primary Examiner*—William E. Terrell
*Assistant Examiner*—Tuan Nguyen
*Attorney, Agent, or Firm*—Linval B. Castle

[57] ABSTRACT

A hand held tool for gathering and later releasing metallic particles such as paper clips or a spilled box of pins or tacks includes a handle with a magnetic attached at the bottom and a sweeper cover covering the magnet and hinged to the handle. Ferrous particles are gathered on the surface of the sweeper cover and later released by pivoting the magnet away from the cover.

5 Claims, 1 Drawing Sheet

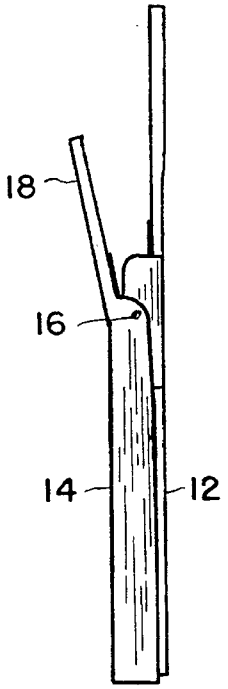
FIG. 1
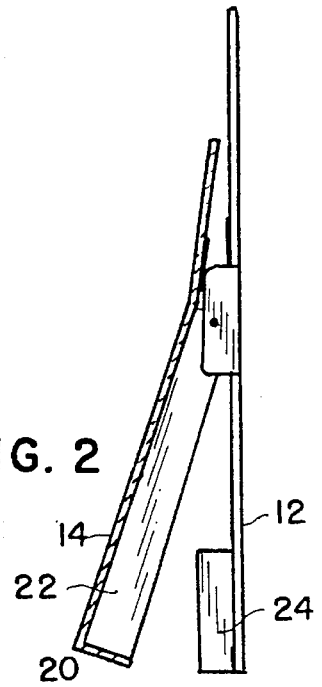
FIG. 2
FIG. 3
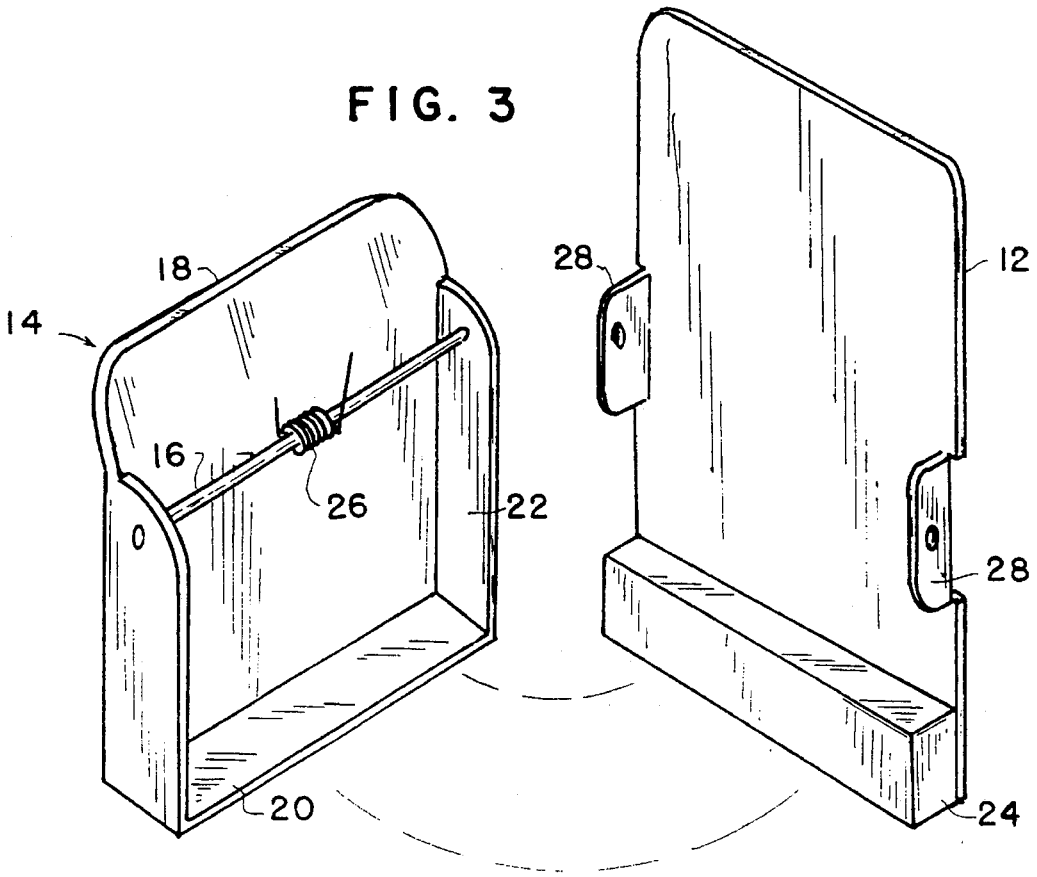

METAL PARTICLE SWEEPER

This invention relates generally to metal sweeping devices and particularly to a novel permanent magnet device for gathering and later releasing small ferrous particles.

BRIEF SUMMARY OF THE INVENTION

The invention is for a manually operated sweeper that is brushed over a surface having a plurality of small iron particles scattered on it, for example, a spilled box of carpet tacks or pins. The magnet in the sweeper will collect the iron particles on one surface of the sweeper, and then at the appropriate time, a spring biased lever is pushed to force the magnet away from the particles thus releasing the magnetic attraction and permitting the particles to drop. The particle sweeper therefore is a mechanically operated permanent magnet that operates in a manner similar to that of an electromagnet.

In its smallest form, the metal particle sweeper is a small hand operated tool for use by an office clerk for gathering paper clips, or by the housewife or hobbyist for picking up pins, needles, tacks and sundry small metal parts. In a larger form it is also a hand operated tool that may be suitable for sweeping the metal scrap from the floor of a machine shop and for separating iron scrap from nonferrous metal scrap.

DESCRIPTION OF THE DRAWINGS

In the drawings which illustrate the preferred embodiment of the invention:

FIG. 1 is a side elevation view of the sweeper in its sweeping position;

FIG. 2 is a sectional side elevational view of the sweeper opened for particle releasing; and FIG. 3 is a perspective view of each of the two parts of the sweeper fanned out to illustrate the internal parts of both.

DESCRIPTION OF THE PREFERRED EMBODIMENT

The metal particle sweeper illustrated in FIG. 1 is a small hand tool to be used for gathering metal particles, such as paper clips or a spilled box of pins or tacks. The sweeper may be formed of plastic or any nonferrous material and includes a handle 12, which in the embodiment illustrated is about two inches high and two inches wide, attached to a sweeper cover 14 by a hinge or a lateral pivot pin 16 located approximately ⅔ up from the bottom of the handle 12. A short cover handle 18 is located above the pivot pin on the sweeper cover 14 and the sweeper cover is provided with a bottom cover 20 and side walls 22 as illustrated in FIG. 2.

The particle sweeper 10, in its closed position of FIG. 1, is swept in a direction toward the left in the drawings so that the particles to be picked up will adhere to the sweeper cover 14 by the attraction of a bar magnet 24 attached at the lower end of the handle 12 as shown in FIG. 2.

Release of the particles picked up on the sweeper cover 14 is made by merely depressing the cover handle 18 against the larger handle 12 thereby hinging or pivoting out the handle 12 from the sweeper cover to remove the bar magnet 24 from the sweeper cover 14 thus removing the magnetic attraction holding the metal particles.

FIG. 3 is a perspective view of all parts of the metal particle sweeper, fanned out to show the detail of the sweeper 10. FIG. 3 shows that the pivot pin 16 supported by the side walls 22 of the sweeper cover 14 itself supports a coil spring 26 which biases the metal particle sweeper closed as illustrated in FIG. 1. FIG. 3 also shows that the handle 12 is formed with projections 28 at the pivot positions on each side edge with holes for engagement with the pivot pin 16.

It is apparent that larger metal particle sweepers may be made using the same type of magnetic attraction and release described. The larger type of particle sweepers may be used for gathering metal particles from the floor around lathe or milling machines or, since magnets only attract ferrous metals, the sweepers may be used to separate ferrous from nonferrous particles.

We claim:

1. A metal particle sweeper for gathering and later releasing ferrous metal particles, said sweeper comprising:

a handle having an upper and lower end;

a magnet attached to said lower end of said handle; and a sweeper cover adjacent said magnet and covering the lower and side surfaces of said magnet, said sweeper cover coupled to said handle by a lateral pivot pin between said magnet and a cover handle above said pivot pin, the metal particles to be gathered on said sweeper cover and released by pivoting said sweeper cover away from said magnet by pressing together said cover handle and said handle.

2. The particle sweeper claimed in claim 1 wherein said lateral pivot pin extends laterally across said particle sweeper.

3. The particle sweeper claimed in claim 2 wherein said handle has side projections for engaging said pivot pin.

4. The particle sweeper claimed in claim 2 further including a coil spring on said pivot pin for biasing apart said handle and said cover handle.

5. The particle sweeper claimed in claim 1 wherein said handle and said sweeper cover are of non-ferrous material.

* * * * *